US006814856B1

(12) United States Patent
Aussillous et al.

(10) Patent No.: US 6,814,856 B1
(45) Date of Patent: Nov. 9, 2004

(54) METHOD FOR IMPROVING A GAS OIL FRACTION CETANE INDEX

(75) Inventors: Marcel Aussillous, Vienne (FR); Alain Billion, Le Vesinet (FR); Patrick Briot, Pommer de Beaurepaire (FR); Christophe Gueret, St Romain en Gal (FR); Slavik Kasztelan, Rueil Malmaison (FR); Narhalie Marchal, Saint Genis Laval (FR); Pierre Marion, Sceaux (FR)

(73) Assignee: Institut Francais du Petrole, Rueil-Malmaison (FR)

( * ) Notice: Subject to any disclaimer, the term of this patent is extended or adjusted under 35 U.S.C. 154(b) by 0 days.

(21) Appl. No.: 09/445,573

(22) PCT Filed: Apr. 9, 1999

(86) PCT No.: PCT/FR99/00817

§ 371 (c)(1),
(2), (4) Date: May 4, 2000

(87) PCT Pub. No.: WO99/52993

PCT Pub. Date: Oct. 21, 1999

(30) Foreign Application Priority Data

Apr. 9, 1998 (FR) ..... 98 04605

(51) Int. Cl.[7] ..... C10G 65/12

(52) U.S. Cl. ..... 208/57; 208/58; 208/59; 208/89

(58) Field of Search ..... 208/57, 58, 59, 208/89, 14, 15

(56) References Cited

U.S. PATENT DOCUMENTS

| | | | | | |
|---|---|---|---|---|---|
| 3,203,889 | A | * | 8/1965 | Pollitzer et al. | 208/57 |
| 4,415,436 | A | | 11/1983 | Angevine | 208/89 |
| 5,143,595 | A | | 9/1992 | Thomas et al. | 208/58 |
| 5,720,872 | A | * | 2/1998 | Gupta | 208/57 |
| 5,865,985 | A | * | 2/1999 | Desai et al. | 208/57 |
| 5,968,346 | A | * | 10/1999 | Jung et al. | 208/210 |
| 6,210,561 | B1 | * | 4/2001 | Bradow et al. | 208/89 |
| 6,264,827 | B1 | * | 7/2001 | Okazaki et al. | 208/57 |

FOREIGN PATENT DOCUMENTS

| | | | |
|---|---|---|---|
| FR | 2600669 | * | 12/1987 |

* cited by examiner

*Primary Examiner*—Walter D. Griffin
(74) *Attorney, Agent, or Firm*—Millen, White, Zelano, Branigan, P.C.

(57) ABSTRACT

A process for transforming a gas oil cut from a conversion process or from an aromatic crude is described, the aim of the process being to improve the cetane number of said cut. The process comprises at least one hydrogenation step in which said gas oil cut is passed, in the presence of hydrogen, over a catalyst comprising an amorphous mineral support, at least one compound of a group VIB metal, at least one compound of a non noble group VIII metal and at least phosphorous or a compound of phosphorous, the process then comprising a hydrocracking step in which the hydrogenated feed is passed, in the presence of hydrogen, over a catalyst comprising an acidic support, at least one compound of a group VIB metal and at least one compound of a non noble group VIII metal.

15 Claims, No Drawings

METHOD FOR IMPROVING A GAS OIL FRACTION CETANE INDEX

The present invention relates to the field of fuels for internal combustion engines. More particularly, it relates to the production of a fuel for a compression ignition engine, and to the fuel obtained therefrom.

Whether from straight run distillation of a crude petroleum or from a conversion process such as catalytic cracking, gas oil cuts still contain non negligible quantities of aromatic compounds, nitrogen-containing compounds and sulphur-containing compounds. Current legislation in the majority of industrialised countries requires that a fuel for use in engines must contain less than 500 parts per million (ppm) of sulphur. In the vast majority of those countries, there are currently no regulations imposing a maximum aromatic compound and nitrogen content. However, a number of countries or states, for example Sweden and California, envisage limiting the quantity of aromatic compounds to a value of less than 20% by weight, or even to less than 10%, and some experts think that that limit should be 5%. In Sweden in particular, some classes of diesel fuel already have to satisfy very strict regulations. Thus in that country, class II diesel fuel must not contain more than 50 ppm of sulphur and more than 10% by weight of aromatic compounds, and class I fuel must not contain more than 10 ppm of sulphur and 5% by weight of aromatic compounds. Currently in Sweden, class III diesel fuel must contain less than 500 ppm of sulphur and less than 25% by weight of aromatic compounds. Similar limits have to be satisfied to sell that type of fuel in California.

Meanwhile, motorists in a number of countries are pressing for legislation to require oilmen to produce and sell a fuel with a minimum cetane number of constantly improving quality. Current European legislation requires a minimum cetane number of 49 which from the year 2000 will rise to 51, probably at least 53 and more probably in the range 55 to 70.

Further, the same European regulations predict a tightening of the regulations regarding the density, the 95% point, sulphur content and polyaromatics content.

A number of specialists seriously envisage the possibility of a future standard imposing a nitrogen content of less than about 200 ppm, for example, and even less than 100 ppm by weight. A low nitrogen content results in a better product stability and is generally desired both by the vendor of the product and by the manufacturer.

It is thus necessary to develop a reliable and effective process which enables a product to be produced which has improved characteristics both as regards the cetane number and the aromatic compound content, sulphur content and nitrogen content. The gas oil cuts originate either from straight run crude oil distillation, or from catalytic cracking: i.e., light distillate cuts (LCO, Light Cycle Oil), heavy fraction cuts (HCO, Heavy Cycle Oil), or from another conversion process (cokefaction, visbreaking, residue hydroconversion, etc.), or from gas oils from the distillation of aromatic or naphthenoaromatic Hamaca, Zuata, or El Pao type crude oil. The production of an effluent which is directly and integrally upgradeable as a very high quality fuel cut is particularly important.

Conventional processes can improve the cetane number to an extent which satisfies current cetane number regulations for the majority of feeds. However, with gas oil cuts originating from a catalytic cracking type conversion process or in the case of particularly severe specifications, this increase reaches a limit which cannot be exceeded using the conventional sequences of such processes.

Further, a well known advantage of these catalysts is that a prolonged service life is possible without observing any deactivation.

The prior art describes processes for hydrogenating petroleum cuts which are particularly rich in aromatic compounds which use a catalyst, for example U.S. Pat. No. 5,037,532 or the publication "Proceedings of the 14$^{th}$ World Petroleum Congress, 1994, p. 19–26" which describe processes which lead to the production of hydrocarbon cuts, and increase in the cetane number is obtained by intense hydrogenation of the aromatic compounds.

We have now sought to produce fuels with a cetane number of the same order as those obtained by conventional hydrogenation processes or higher but without having recourse to hydrogenation which is too intense.

The present invention is distinguished over the prior art in that it combines hydrocracking with hydrogenation.

Such a combination has already been described for the treatment of heavy feeds, for example in French patent FR-A-2 600 669.

In that patent, the treated feed contains at least 50% by weight of constituents boiling above 375° C. and the aim of the process is to convert at least 70% by volume of those heavy constituents to constituents with a boiling point of less than 375° C.

At the end of the process, at least one cut is produced with a boiling point below 375° C. (gasoline, gas oil) and a heavy cut is produced with a boiling point of at least 375° C. which can be recycled to improve conversion. The light compounds are, of course, separated out (residual $H_2$, $C_1$–$C_4$, $H_2S$, $NH_3$ . . . ).

Thus this process comprising a hydrotreatment step followed by a hydrocracking step uses a zeolitic catalyst converts a heavy cut to a gas oil (250–375° C.) and a gasoline (150–250° C.) with the highest yield possible.

The Applicant has been able to establish that, compared with the prior art hydrogenation to treat gas oil cuts, the process of the invention, combining hydrogenation and hydrocracking, breaks the conventional cetane limits encountered in conventional hydrogenation processes and more substantially reduces the 95% ASTM point (the point corresponding to the boiling point of 95% of the cut).

More precisely, the invention provides a process for converting a gas oil cut into a high cetane number fuel which is dearomatised, desulphurised and has good cold properties, the process comprising the following steps:

a) at least one first step termed hydrogenation in which said gas oil cut is passed, in the presence of hydrogen, over a catalyst comprising an amorphous mineral support, at least one metal or compound of a metal from group VIB of the periodic table (Handbook of Chemistry and Physics, 76$^{th}$ Edition, 1995–1996) in a quantity, expressed as the weight of metal with respect to the weight of finished catalyst, of about 0.5% to 40%, at least one non noble metal or compound of an non noble metal from group VIII of the periodic table in a quantity, expressed as the weight of metal with respect to the weight of finished catalyst, of about 0.01% to 30%, and of phosphorous or at least one compound of phosphorous in a quantity, expressed as the weight of phosphorous pentoxide with respect to the weight of the support, of about 0.001% to 20%; and b) at least one second step, termed hydrocracking, in which the hydrogenated product from the first step is passed, in the presence of hydrogen, over a catalyst comprising a mineral support which is partly zeolitic, at least one metal or compound of a metal from group VIB of the periodic table in a quantity, expressed as the weight of metal with respect to the weight of finished catalyst, of about 0.5% to 40% and at least one non noble metal or compound of a non noble metal from group VIII in a quantity, expressed as the weight of metal with respect to the weight of finished catalyst, of about 0.01% to 20%, the light compounds then being separated from the hydrocracking effluent. This two-step process essentially comprises substantial or managed hydrogenation of the aromatic compounds—depending on the amount of aromatic compounds which are to be in the final product, then hydrocracking intended to open the naphthenes produced in the first step, to form paraffins.

These feeds are treated in hydrogen in the presence of catalysts, this treatment enabling the aromatic compounds present in the feed to be hydrogenated; it can also simultaneously carry out is hydrodesulphurisation and hydrodenitrogenation.

In the process of the present invention, the operating conditions for hydrogenation (or hydrotreatment) are as follows: the hourly space velocity (HSV) is in the range 0.1 to 30 volumes of liquid feed per volume of catalyst per hour, preferably in the range 0.2 to 10; the temperature at the reactor inlet is in the range 250° C. to 450° C., preferably in the range 320° C. to 400° C.; the reactor pressure is in the range 0.5 to 20 MPa, preferably in the range 4 to 15 MPa; the pure hydrogen recycle rate is in the range 100 to 2500 $Nm^3/m^3$ of feed, preferably in the range 200 to 2100 $Nm^3/m^3$, more advantageously less than 2000 $Nm^3/m^3$. The hydrogen consumption in the process can be up to about 5% by weight of the feed (0.5–4.5% in general).

The hydrogenation catalyst comprises, on an amorphous mineral support, at least one metal or compound of a metal from group VIB of the periodic table, such as molybdenum or tungsten, in a quantity, expressed as the weight of metal with respect to the weight of finished catalyst, in the range 0.5% to 40%, preferably in the range 2% to 30%, at least one non noble metal or a compound of a non noble metal from group VII of said periodic table, such as nickel, cobalt or iron, in a quantity, expressed as the weight of metal with respect to the weight of finished catalyst, in the range 0.01% to 30%, preferably in the range 0.1% to 10%, phosphorous or at least one phosphorous compound, in a quantity, expressed as the weight of phosphorous pentoxide with respect to the weight of the support, in the range 0.001% to 20%. The catalyst can also contain boron or at least one compound of boron in a quantity, expressed as the weight of boron trioxide with respect to the weight of the support, in the range 0.001% to 10%. The amorphous mineral support is, for example, alumina or silica-alumina. In a particular embodiment of the invention, cubic gamma alumina is used which preferably has a specific surface area of about 50 to 500 $m^2/g$.

The hydrogenation catalyst used in the present invention preferably undergoes a sulphurisation treatment to at least partially transform the metallic species to the sulphide before bringing them into contact with the feed to be treated. This sulphurisation activation treatment is well known to the skilled person and can be carried out using any method which is already known in the literature.

One conventional method which is well known to the skilled person consists of heating the catalyst in the presence of hydrogen sulphide or of a hydrogen sulphide precursor to a temperature in the range 150° C. to 800° C., preferably in the range 250° C. to 600° C., generally in a traversed bed reaction zone.

The term "hydrogen sulphide precursor" as used in the present description means any compound which can react under the operating conditions of the reaction to give hydrogen sulphide.

The hydrogenated products from the first step may or may not undergo a treatment selected from the group formed by gas-liquid separations and distillations. The liquid phase then undergoes hydrocracking in step b) of the present invention.

In the process of the present invention, the operating conditions for the hydrocracking step are as follows: the hourly space velocity (HSV) is about 0.1 to 30 volumes of liquid feed per volume of catalyst per hour, preferably in the range 0.2 to 10, the reactor inlet temperature is in the range 250° C. to 450° C., preferably in the range 300° C. to 400° C.; the reactor pressure is in the range 0.5 to 20 MPa, preferably in the range 4 to 15 MPa and more preferably in the range 7 to 15 MPa; the pure hydrogen recycle rate is in the range 100 to 2200 $Nm^3/m^3$ of feed. Under these conditions, conversion is regulated as a function of the cetane number and the other properties (density, T95 . . . ) to be obtained. The total conversion (hydrocracking b)+that obtained during hydrogenation step a)) can be higher than 50% or less than 50% (5–50%, for example) depending on the cut to be treated.

The catalyst of the second step generally comprises at least one zeolite, at least one support and at least one hydro-dehydrogenating function.

An acidic zeolite is particularly advantageous in this type of embodiment, for example a faujasite type zeolite, preferably a Y zeolite. The zeolite weight content is in the range 0.5% to 80%, preferably in the range 3% to 50% with respect to the finished catalyst. Advantageously, a Y zeolite with a lattice parameter of $24.14\times10^{-10}$ m to $24.55\times10^{-10}$ m is used.

The hydro-dehydrogenating function of the catalyst can advantageously be provided by a combination of metals: further, the catalyst contains at least one oxide or sulphide of a group VIB metal such as molybdenum or tungsten in a quantity, expressed as the weight of metal with respect to the weight of finished catalyst, in the range 0.5% to 40%, and at least one non noble metal or a compound of a non noble metal from group VIII, such as nickel, cobalt or iron in a quantity, expressed as the weight of metal with respect to the weight of finished catalyst, in the range 0.01% to 20%, preferably in the range 0.1% to 10%. These metals are deposited on a support selected from the group formed by alumina, silica, silica-alumina, boron oxide, magnesia, silica-magnesia, zirconia, titanium oxide, clay, used alone or as a mixture, the support representing the complement to 100% of the other constituents of the catalyst. The hydrocracking catalyst used in the present invention preferably undergoes a sulphurisation treatment to transform at least a portion of the metallic species to sulphides before bringing them into contact with the feed to be treated. This sulphurisation activation treatment is well known to the skilled person and can be carried out using any method which is already known in the literature.

One conventional method which is well known to the skilled person consists of heating the catalyst in the presence of hydrogen sulphide or of a hydrogen sulphide precursor to a temperature in the range 150° C. to 800° C., preferably in the range 250° C. to 600° C., generally in a traversed bed reaction zone.

U.S. Pat. No. 5,525,209 characterizes a particularly advantageous HY acid zeolite by different specifications: a $SiO_2/Al_2O_3$ mole ratio in the range 8 to 70, preferably in the range 12 to 40; a sodium content of less than 0.15% by weight determined for the zeolite calcined at 1100° C.; a lattice parameter "a" of the unit cell in the range $24.55\times10^{-10}$ m to $24.24\times10^{-10}$ m, preferably in the range $24.38\times10^{-10}$ m to $24.26\times10^{-}$ m; a sodium ion take-up capacity $C_{Na}$, expressed in grams of Na per 100 grams of modified zeolite, neutralised then calcined, of over 0.85; a specific surface area, determined by the BET method, of more than about 400 $m^2/g$, preferably more than 550 $m^2/g$; a water vapour adsorption capacity for a partial pressure of 2.6 torrs (34.6 MPa) of more than about 6% at 25° C.; a pore distribution in the range 1% to 20%, preferably in the range 3% to 15%, of the pore volume contained in pores with a diameter in the range $20\times10^{-10}$ m to $80\times10^{-10}$ m; the remainder of the pore volume mainly being contained in pores with a diameter of less than $20\times10^{-10}$ m.

In general, the Y—Na zeolite from which the HY zeolite is prepared has a $SiO_2/Al_2O_3$ mole ratio in the range 4 to 6; it is appropriate to first reduce the amount of sodium (by weight) to a value of the order of 1% to 3%, preferably to less than 2.5%; the Y—Na zeolite also generally has a specific surface area in the range about 750 $m^2/g$ to 950 $m^2/g$.

A number of variations of the preparations exist in which the hydrothermal treatment of the zeolite is generally followed by an acid treatment.

The effluent obtained from hydrocracking is fractionated to separate the light (cracked) products, i.e., products boiling below 150° C. in general, or below 180° C. or another temperature selected by the refiner. Thus at least one 150° C.+ or 180° C.+ gas oil cut is obtained. If the feeds contain compounds with a boiling point of more than 370° C., they can advantageously be separated, preferably to recycle them to the hydrogenation and/or hydrocracking step. Instead of cutting them at 370° C., they can be cut at a lower temperature, for example at 350° C., depending on the refiner's requirements.

The present invention thus enables gas oils to be obtained with a cetane number, and possibly the aromatic compound content, which is improved such that the cuts can satisfy the current and future regulations. These gas oil cuts can be sold directly.

The present invention can maximally upgrade all of the products contained in the treated petroleum cut. The yield of upgradeable products is close to 99% of the amount of hydrocarbons; in contrast to conventional processes, there are no liquid or solid waste products to be incinerated.

The gas oil feeds to be treated are preferably light gas oils such as straight run gas oils, gas oils from fluid catalytic cracking (FCC) or LCO. They generally have an initial boiling point of at least 180° C. and a final boiling point of at most 370° C. More broadly, the invention can be applied to gas oil cuts with an initial boiling point of at least 150° C., at least 80% by weight of which boils at at most 370° C., and advantageously at least 90% of which boils at at most 370° C. The composition by weight per hydrocarbon family of these feeds varies depending on the ranges. In a typical to composition, the contents (by weight) of paraffins are in the range 5.0% to 30.0%, of naphthenes in the range 5.0% to 40.0% by weight and of aromatic compounds in the range 40.0% to 80.0%. Less aromatic feeds containing less than 40% of aromatics and generally 20% to less than 40% of aromatics can also be treated, the naphthene content possibly rising to 60%.

The following examples illustrate the invention without limiting its scope.

In the Examples below, the catalyst used in the hydrogenation step had the following characteristics: the nickel content, in the oxide form, was 3%; the molybdenum content, in the oxide form, was 16.5% with 6% of phosphorous pentoxide on alumina. For hydrocracking, a catalyst was advantageously used in which the support was alumina. This catalyst contained 12% by weight of molybdenum, 4% of nickel in the form of oxides and 10% of Y zeolite, this catalyst being described in Example 2 of U.S. Pat. No. 5,525,209.

These catalysts were sulphurised using a mixture of n-hexane/DMDS+aniline up to 320° C. after 3000 hours of continuous operation, no deactivation of the catalysts as described in the example was observed.

EXAMPLE 1

The feed was treated in a pilot unit comprising two reactors in series under the following conditions: the space velocity in the two reactors was 0.29 volumes of liquid feed per volume of catalyst per hour, the temperature at the first reactor inlet was 380° C. for hydrogenation and 390° C. for hydrocracking; the pressure in the two reactor was 14 MPa. In each reactor, the hydrogen recycle rate was 2000 $Nm^3$ per $m^3$ of feed. The characteristics of the feed and the 190° C.+ product obtained after each step are shown in Table 1, after the hydrocracking step and after distillation.

TABLE 1

| Characteristics | Feed | 190° C. + product after hydrocracking |
|---|---|---|
| Density at 15° C. | 0.947 | 0.831 |
| Pour point ° C. | 3 | −7 |
| Motor cetane number | 32 | 56 |
| Total nitrogen (by weight) ppm | 1290 | <1 |
| Sulphur (by weight) ppm | 19700 | <1 |
| Paraffins % (by weight) | 15 | 30 |
| Naphthenes % (by weight) | 17.3 | 69 |
| Aromatic compounds % (by weight) | 67.7 | 1 |
| $H_2$ consumption % (by weight) | | 4.22 |
| T95 ° C. | 397 | 353 |

EXAMPLE 2

The feed was treated in a pilot unit comprising two reactors in series under the following conditions: the space velocity in the two reactors was 0.25 volumes of liquid feed per volume of catalyst per hour, the temperature at the first reactor inlet was 385° C. for hydrogenation and in the second reactor, it was 375° C. for hydrocracking; the pressure in the two reactors was 14 MPa. In each reactor, the hydrogen recycle rate was 2000 $Nm^3$ per $m_3$ of feed. The characteristics of the feed and the products obtained after each step are shown in Table 2.

TABLE 2

| Characteristics | Feed | Product after hydrocracking |
|---|---|---|
| Density at 15° C. | 0.951 | 0.827 |
| Pour point ° C. | −36 | −45 |
| Motor cetane | 18 | 53 |
| Total nitrogen (by weight) ppm | 826 | <1 |
| Sulphur (by weight) ppm | 17600 | <1 |

EXAMPLE 3

The feed was treated in the pilot unit of Example 1 comprising two reactors in series, under the following conditions: the space velocity in the two reactors was 0.25 volumes of liquid feed per volume of catalyst per hour, the temperature at the first reactor inlet was 360° C. for hydrogenation and in the second reactor, it was 367° C. for hydrocracking; the pressure in the two reactors was 14 MPa. In each reactor, the hydrogen recycle rate was 2000 $Nm^3$ per $m^3$ of feed. The characteristics of the feed and the products obtained after each step are shown in Table 3.

TABLE 3

| Characteristics | Feed | Product after hydro-genation | 150° C. + product after hydro-cracking |
|---|---|---|---|
| Density at 15° C. | 0.951 | 0.874 | 0.835 |
| Motor cetane number | 18 | 33 | 44 |
| Total nitrogen (by weight) ppm | 830 | <1 | <1 |
| Sulphur (by weight) ppm | 17600 | <30 | <30 |
| Paraffins % (by weight) | 11 | 8 | 11 |
| Naphthenes % (by weight) | 10 | 87 | 85 |
| Aromatic compounds % (by weight) | 79 | 5 | 4 |
| $H_2$ consumption % (by weight) | | 3.26 | 4.73 |
| 95% TBP point ° C. | 378 | 342 | 322 |

It can be seen that, using the process of the invention (Examples 1 and 2), with feeds with a high aromatic compound content, a final product is obtained which has the following characteristics: a high cetane number, low aromatic compound contents, in particular di- and polyaromatic compounds, low sulphur, low nitrogen, a low pour point and a low 95% point. The gas oil cut obtained by this process was very high quality, it satisfied the regulations, even the most draconian thereof, imposed by different states.

This Example 3 shows the gain of the hydrocracking step in the quality of the products; the gains obtained on the single hydrocracking catalyst were 39/1000ths of density, 22° C. at the 95% point and 11 cetane points.

This process for improving the cetane number in two steps produces a gas oil cut with a high cetane number. Thus the base cut can be hydrogenated to a greater or lesser extent depending on whether the regulations for the aromatic compounds of a given country are to be satisfied, but in all cases, hydrogen is saved compared with conventional processes for improving gas oil cuts.

The invention has two major advantages: it can economise on hydrogen since a less intense hydrogenation is carried out to obtain the same cetane number; it can also enable a reserve of aromatic compounds to be constituted which can, as required, be hydrogenated in a subsequent hydrogenation step, which means a potential increase in the cetane number. The latter case more particularly concerns starting gas oil cuts with high aromatic compound contents (40–80% by weight). The hydrogenation step is carried out with any known hydrogenation catalyst, in particular those containing at least one noble metal deposited on an amorphous refractory oxide support (for example alumina). A preferred catalyst contains at least one noble metal (preferably platinum), at least one halogen (preferably 2 halogens: chlorine and fluorine) and a matrix (preferably alumina). The hydrogenation step can be carried out on the total effluent leaving the hydrocracking step, separation of the 150– compounds (preferably 180– compounds) thus taking place after this hydrogenation step. The hydrogenation step can also be carried out on the 150+ cut (or 180+ cut depending on the fraction selected), optionally followed by separation of the 150– (or 180–) compounds.

The limit imposed by conventional intense hydrogenation processes is fixed by the amount of aromatic compounds. Once these aromatic compounds have all been hydrogenated, there is no possibility of increasing the cetane number, but in contrast by combining hydrocracking with hydrogenation, the cetane number can be increased still further, by increasing the paraffin content in the cut. When gas oil cuts with low aromatic compound contents (20% to less than 40%) are used, the combination of the invention of the hydrogenation step then the hydrocracking step can produce a high cetane number, which could not be obtained with intense hydrogenation used in the prior art. Thus the sequence of processes we propose here enables the limit imposed by intense hydrogenation processes to be broken and the cetane number can be increased beyond regulation requirements.

With the process of the invention, fuels with sulphur contents below 500 ppm, or even below 50 ppm or even below 10 ppm are produced. At the same time, the cetane numbers remain at least 49 or at least 50. The aromatic compound content is generally at most 20% (5–20%) and the polyaromatic compound content is reduced to below 1%.

Compared with the conventional intense hydrogenation process, the process of the invention can produce larger gains in the properties listed below. The gain is the difference observed between the values of the property for the product and that for the starting product.

| | |
|---|---|
| Density at 15° C. | Gain generally about 100/1000ths and more |
| Cetane (150+ cut) | Gain of at least 20 or 25 which can rise to +35 or more as opposed to about 20 in hydrogenation processes |
| 95% point | Gains of 25° C. to 60° C. or more, as opposed to 10–20° C. maximum for hydrogenation. |

These values are given by way of indication only, and do not constitute a minimum to achieve nor a maximum achieved.

What is claimed is:

1. A process for converting a gas oil cut into a high cetane number fuel which is dearomatised and desulphurised, said process comprising at least one first step (a) in which hydrogenation is performed to produce a hydrogenated product, wherein said gas oil cut is passed, in the presence of hydrogen, over a catalyst comprising an amorphous mineral support, at least one metal or compound of a metal from group VIB of the periodic table in a quantity, expressed as the weight of metal with respect to the weight of finished catalyst, of about 0.5% to 40%, at least one non noble metal or compound of a non noble metal from group VIII of the periodic table in a quantity, expressed as the weight of metal with respect to the weight of finished catalyst, of about 0.01% to 30%, and phosphorous or at least one phosphorous compound in a quantity, expressed as the weight of phosphorous pentoxide with respect to the weight of the support, of about 0.001% to 20%; and at least one second step (b) in which hydrocracking is performed to produce an effluent containing light compounds, wherein said hydrogenated product from the first step is passed, in the presence of hydrogen, over a catalyst comprising a mineral support which is partly zeolitic, at least one metal or compound of a metal from group VIB of the periodic table in a quantity, expressed as the weight of metal with respect to the weight of finished catalyst, of about 0.5% to 40% and at least one non noble metal or compound of a non noble metal from group VIII in a quantity, expressed as the weight of metal with respect to the weight of finished catalyst, of about 0.02% to 20%, and then separating said light compounds from the hydrocracking effluent, wherein said gas oil cut introduced into the hydrogenation step has an initial boiling point of at least 150° C., at least 90 wt % of which boils at at most 370° C., wherein total conversion of the gas oil cut in the hydrocracking and hydrogenation steps is less than 50% w/w.

2. A process according to claim 1, in which the boiling point of the gas oil cut is in the range 180–370° C.

3. A process according to claim 1, in which the aromatic compound content of the gas oil cut is in the range 40–80% by weight.

4. A process according to claim 1, in which the gas oil cut has an aromatic compound content of at least 20% by weight and less than 40% by weight.

5. A process according to claim 1, in which the metal from group VIB in the catalyst of step a) is molybdenum or tungsten, and the metal from group VIII of the catalyst of step a) is nickel, cobalt or iron.

6. A process according to claim 1, in which the metal from group VIB of the catalyst of step b) is molybdenum or tungsten and the metal from group VIII of the catalyst of step b) is nickel, cobalt or iron.

7. A process according to claim 1, wherein the products from hydrogenation step a) undergo a treatment selected from the group formed by either gas-liquid separation or distillation, the hydrocracking step b) being thereafter carried out on the resultant separated liquid phase.

8. A process according to claim 1, in which the operating conditions for steps a) and b) comprise a temperature of about 250° C. to about 450° C., a total pressure of about 0.5 to 20 MPa and a global hourly space velocity of liquid feed of about 0.1 to about 30 $h^{-1}$.

9. A process according to claim 1, in which the catalyst for step a) comprises a metal or a compound of a metal selected from the group consisting of molybdenum and tungsten in a quantity, expressed as the weight of metal with respect to the weight of finished catalyst, in the range 2% to 30%, and a metal or compound of a metal selected from the group consisting of nickel, cobalt and iron in a quantity, expressed as the weight of metal with respect to the weight of finished catalyst, in the range 0.1% to 10%.

10. A process according to claim 1, in which the catalyst of step a) comprises boron or at least one compound of boron.

11. A process according to claim 10, in which the catalyst of step a) comprises boron or at least one compound of boron in a quantity, expressed as the weight of boron trioxide with respect to the weight of the support, of about 0.001% to 10%.

12. A process according to claim 1, further comprising subjecting effluent from the hydrocracking step to a hydrogenation step.

13. A process according to claim 1, wherein said process produces a 150° C.+ cut having a cetane number which is at least 20 points higher than the gas oil cut introduced into the hydrogenation step.

14. A process according to claim 1, wherein the gas oil cut which is introduced into the hydrogenation step comprises 5–30% by weight paraffins, 5–40% by weight naphthenes, and 40–80% by weight aromatic compounds.

15. A process for converting a gas oil cut into a high cetane number fuel which is dearomatised and desulphurised, said process comprising at least one first step (a) in which hydrogenation is performed to produce a hydrogenated product, wherein said gas oil cut is passed, in the presence of hydrogen, over a catalyst comprising an amorphous mineral support, at least one metal or compound of a metal from group VIB of the periodic table in a quantity, expressed as the weight of metal with respect to the weight of finished catalyst, of about 0.5% to 40%, at least one non noble metal or compound of a non noble metal from group VIII of the periodic table in a quantity, expressed as the weight of metal with respect to the weight of finished catalyst, of about 0.01% to 30%, and phosphorous or at leastone phosphorous compound in a quantity, expressed as the weight of phosphorous pentoxide with respect to the weight of the support, of about 0.001% to 20%; and at least one second step (b) in which hydrocracking is performed to produce an effluent containing light compounds, wherein said hydrogenated product from the first step is passed, in the presence of hydrogen, over a catalyst comprising a mineral support which is partly zeolitic, at least one metal or compound of a metal from group VIB of the periodic table in a quantity, expressed as the weight of metal with respect to the weight of finished catalyst, of about 0.5% to 40% and at least one non noble metal or compound of a non noble metal from group VIII in a quantity, expressed as the weight of metal with respect to the weight of finished catalyst, of about 0.02% to 20%, and then separating said light compounds from the hydrocracking effluent, wherein said gas oil cut introduced into the hydrogenation step has an initial boiling point of at least 150° C., 90 wt % of which boils at at most 370° C.

* * * * *

UNITED STATES PATENT AND TRADEMARK OFFICE

CERTIFICATE OF CORRECTION

PATENT NO. : 6,814,856 B1 
DATED : November 9, 2004
INVENTOR(S) : Marcel Aussillous et al.

It is certified that error appears in the above-identified patent and that said Letters Patent is hereby corrected as shown below:

Title page,
Item [75], Inventors, second inventor reads "Billion" should read -- Billon --

Signed and Sealed this

Thirty-first Day of May, 2005

JON W. DUDAS
*Director of the United States Patent and Trademark Office*